US005607547A

United States Patent [19]

Nye et al.

[11] Patent Number: 5,607,547

[45] Date of Patent: Mar. 4, 1997

[54] METHOD FOR REDUCED SULFUR DIOXIDE FORMATION IN REFINER BLEACHING

[75] Inventors: Jeffrey Nye, Huntersville, N.C.; Martin G. Fairbank, Milton, Canada

[73] Assignee: Hoechst Celanese Corporation, Somerville, N.J.

[21] Appl. No.: 445,318

[22] Filed: May 19, 1995

Related U.S. Application Data

[63] Continuation of Ser. No. 55,121, Apr. 30, 1993, abandoned, which is a continuation-in-part of Ser. No. 990,348, Dec. 14, 1992, abandoned.

[51] Int. Cl.[6] ..... D21B 1/16; D21C 9/12

[52] U.S. Cl. ..... 162/26; 162/83; 162/90

[58] Field of Search ..... 162/26, 82, 83, 162/90

[56] References Cited

U.S. PATENT DOCUMENTS

| | | | |
|---|---|---|---|
| 2,883,826 | 4/1959 | Smith et al. | 162/83 |
| 3,013,931 | 12/1961 | Wethern et al. | 162/83 |
| 3,388,037 | 6/1968 | Asplund et al. | 162/26 |
| 3,804,944 | 4/1974 | Kise et al. | 423/265 |
| 3,985,674 | 10/1976 | Ellis et al. | 252/188 |
| 4,411,737 | 10/1983 | Galeano | 162/83 |
| 4,534,954 | 8/1985 | Little et al. | 423/515 |
| 5,129,987 | 7/1992 | Joachimides et al. | 162/83 |

FOREIGN PATENT DOCUMENTS

| | | |
|---|---|---|
| 153671 | 2/1985 | European Pat. Off. . |
| 333398 | 9/1989 | European Pat. Off. . |
| 4115575 | 5/1991 | Germany . |
| 1374029 | 11/1974 | United Kingdom . |
| 2215350 | 9/1989 | United Kingdom . |

OTHER PUBLICATIONS

Tappi, "Borohydride Solutions for Bleaching Paper", Wayman, M. et al, vol. 52, No. 1, 1969, pp. 89–92.

Trade Literature, Virginia Chemicals Inc., "The Application of Hydrosulfites in the Brightening of Boxboard Furnishes", Bulletin 607, 1st Revision.

Trade Literature, Virginia Chemicals Inc., "The Decolorization of Dyed Paper Stock with Hydrosulfites", Bulletin 607B, 1st Revision.

Internal Memo, May 14, 1993.

Canadian Journal of Chemistry, "Sodium Dithionite, Decomposition in Aqueous Solution and in the Solid State", Lister, M. W. and Garvie, R. C., vol. 37, 1959, pp. 1567–1574.

Report 780, "Bleaching with Reductive Agents", Kise, Mearl A., Feb., 23, 1976.

The Bleaching of Pulp, Third Edition, Revised, "Bleaching with Reductive Agents", Kise, Mearl A., Edited by Singh, R. P., (1953, 1963, 1979), Chapter 9, pp. 255–273.

International Standard ISO 2469, "Paper, board and pulps —Measurement of diffuse reflectance factor", Second edition —1977–02–15.

International Standard ISO 2470, "Paper and board —Measurement of diffuse blue reflectance factor (ISO brightness)", Second Edition —1977–02–15.

Standard E.1, "Brightness of pulp, paper and paperboard" & (Appendices I and II).

*Primary Examiner*—Steven Alvo

*Attorney, Agent, or Firm*—Rosemary Miano

[57] ABSTRACT

A method for eliminating the formation of sulfur dioxide in a refiner bleaching process is disclosed wherein a selected amount of a carbonate is added to the refiner contents at approximately the same time that sodium dithionite is added.

8 Claims, No Drawings

METHOD FOR REDUCED SULFUR DIOXIDE FORMATION IN REFINER BLEACHING

The application is a continuation of U.S. patent application Ser. No. 08/055,121, filed Apr. 30, 1993, now abandoned, which is a continuation-in-part of U.S. patent application Ser. No. 07/990,348, filed on Dec. 14, 1992, now abandoned.

BACKGROUND OF THE INVENTION

This invention relates to a method for reducing or eliminating the formation of sulfur dioxide during refiner bleaching with sodium hydrosulfite.

One of the first steps in making paper is the pulping of wood. The wood pulp created during the refining process is frequently not bright enough for use in paper formation without some type of treatment to brighten the pulp. Refiner bleaching is a widely accepted way of bleaching wood pulp. (See, for example, U.S. Pat. No. 5,129,987 to Joachimedes et al as one example of a paper and pulp refiner bleaching process. This process uses sodium hydrosulfite in the presence of a strong alkali such as NaOH.) During the process of refiner bleaching, one or more chemicals are added to the refiner. One such chemical is sodium hydrosulfite, $Na_2S_2O_4$, also called sodium dithionite. Due to problems associated with the decomposition of sodium hydrosulfite and the formation of sulfur dioxide during the extreme conditions of temperature and pressure present in a refiner, refiner bleaching has not enjoyed widespread popularity.

Sulfur dioxide is a corrosive and toxic chemical that combines with water to form sulfurous acid, another corrosive chemical. Pulp mills are especially sensitive to the formation of sulfur dioxide and the associated formation of sulfurous acid since most mills recover steam formed during the refining operation in order to reduce energy costs. Recovery and/or neutralization systems that render the acids harmless are very expensive. Also, at some point in the heat recovery system there will likely be some types of steels that are susceptible to attack by sulfur dioxide and sulfurous acid..

The continued requirement for increasingly higher brightness in paper has forced many manufacturers to look at alternatives to sodium hydrosulfite bleaching even though sodium hydrosulfite gives quite satisfactory results when used as a bleaching agent. Conventional tower bleaching with sodium hydrosulfite yields a brightness increase of about 6–10% based on International Standards Organization scale units (ISO) or as measured by other comparable scales such as Standard E.1 (including Appendices I and II) from the Physical and Chemical Standards Committee, Technical Section, Canadian Pulp and Paper Association, incorporated by reference in its entirety herein. An additional two points can be gained by splitting the hydrosulfite addition into two sequential dosages. Yet another two points of brightness can be achieved by performing the first stage of brightening in a mechanical pulping device such as a refiner or grinder, for example, of the type described in U.S. Pat. No. 5,129,987 to Joachimedes et al, (and its counterpart European Patent Application No. 0 333 398) incorporated by reference in its entirety herein. It would be advantageous, therefore, to continue the use of refiner bleaching with hydrosulfite if some way could be found to reduce or eliminate the formation of sulfur dioxide.

Thus, it is an object of this invention to provide a method for using sodium hydrosulfite in refiner bleaching processes without the formation of sulfur dioxide or with a reduction in the amount of sulfur dioxide formed. It is a further object of this invention to make the use of refiner bleaching with sodium hydrosulfite a more environmentally acceptable method of bleaching pulp. It is yet another object of the invention to enable the paper industry to obtain pulp having good brightness qualities. These and other objects of the invention will be apparent from the following description.

SUMMARY OF THE INVENTION

A process is provided wherein wood pulp is bleached in a refiner or a pulp grinding apparatus with sodium hydrosulfite and a carbonate such as sodium carbonate. The addition of the carbonate reduces or eliminates the formation of sulfur dioxide.

DETAILED DESCRIPTION OF THE INVENTION AND DESCRIPTION OF THE PREFERRED EMBODIMENTS

A process is provided wherein wood pulp is bleached in a refiner or a pulp grinding apparatus (collectively referred to hereinafter as refiners), such as the one described in the above referenced British patent application, but without the formation of sulfur dioxide or with a reduction in the amount of sulfur dioxide formed. Sulfur dioxide, especially in combination with water, forms a highly corrosive environment for pulp equipment. It has been found that the addition of a carbonate such as sodium carbonate reduces the formation of sulfur dioxide in a refiner containing sodium hydrosulfite to the point of virtually eliminating the formation of sulfur dioxide, such as to an amount below one part per million. Typical levels of sulfur dioxide emissions from refiner bleaching may be in the range of zero to 100 parts per million. Typical values may be in the range of 10 to 50 parts per million. By using the invention described herein, reductions down to 1 to 2 parts per million and even 0 part per million may be achieved.

One or more carbonates selected from the group consisting of lithium carbonate, sodium carbonate, potassium carbonate, magnesium carbonate and calcium carbonate may be used in carrying out the process of this invention. Sodium carbonate is preferred. In order to substantially reduce or eliminate the sulfur dioxide formed, an effective amount of carbonate used is selected in the range of from about 20 to about 150 weight percent based on the amount of sodium hydrosulfite used, and, more particularly, in the range of about 20 to 75 weight percent. An even more particular range for the carbonate is from about 33 to 50 weight percent (inclusive). Generally sodium hydrosulfite is used in such systems in an amount between 0.1 and 2.0 weight percent based on the oven-dry weight of pulp being processed.

The carbonate (such as sodium carbonate) and sodium hydrosulfite must be present in the refiner simultaneously but may be added separately. The carbonate and sodium hydrosulfite may be added separately at about the same time or simultaneously to the refiner. In a preferred application of the invention, the carbonate and hydrosulfite are both present in a solution that is added into the refining zone. There is a danger in adding the carbonate too soon before the hydrosulfite in that alkali darkening of the pulp may occur. Similarly, addition of the carbonate too long after the hydrosulfite would not ensure complete elimination of the sulfur dioxide.

In a preferred version of the method of the invention sodium carbonate in an amount equal to fifty weight percent of the amount of sodium hydrosulfite added to the refiner is needed to completely eliminate the formation of sulfur dioxide. The sodium carbonate is added at the same time as the sodium hydrosulfite is added.

EXAMPLES

The following non-limiting Examples are illustrative of the invention but should not be construed as limitations thereon. Unless otherwise specified, chemical symbols have their customary meaning, percents are weight percents, temperatures are in degrees Centigrade, OD means oven dried, and ppm means parts per million.

EXAMPLES 1–7

Southern pine wood chips were refined in a Sunds Defibrator CD 300 pilot plant refiner. The wood chips were presteamed for 20 minutes at atmospheric pressure and then fed into the refiner by means of a plug screw feeder. Sufficient dilution water was added into the refining zone so that the consistency of the refiner contents was approximately 25% (25 percent solids). Sodium hydrosulfite was added as a bleach solution into the refining zone in an amount equal to one percent based on the weight of oven dried wood. For Examples which contained sodium carbonate, the sodium carbonate was dissolved in the bleach solution in varying amounts as listed in Table I. Sodium hydroxide was added to adjust the pH of the bleach solution to about 10.5. Note that additional sodium carbonate could have been used here instead of the NaOH. Other bases could also be used, such as other hydroxides, in order to adjust the pH to the desired level, provided such bases do not have an adverse effect on the pulp.

The vent gas from the refiner was continuously monitored for sulfur dioxide using two methods. The data from these measurements is also recorded in Table I. In the first method, approximately 60 milliliters of gas were drawn into a plastic syringe and then injected into a detector tube (Gas Tech Analyzer tube, catalogue number 5LB). The detector tube contained a color changing indicator specific for sulfur dioxide. The data is recorded under the Gas Tech column in Table I.

In the second method, an electrochemical sensing device (IS Plant Rat, Model IS-PRS-1, B&W Technologies, Calgary, Alberta, Canada) was used to continuously monitor a stream of vent gas provided by a personal air sampling pump (Model number SP-13P, Supelco, Incorporated, Bellefonte, Pa.). The data is recorded in Table I under Plant Rat. The sensitivity of the Plant Rat is about 0.1 ppm. The sensitivity of the Gas Tech Tube is 0.1 ppm. While both of these methods are listed as having the same sensitivity, it is believed that the Plant Rat provides a more accurate determination of the actual amount of $SO_2$.

As shown in Table I for both sets of gas data, addition of 33 percent of sodium carbonate significantly reduced the amount of sulfur dioxide formed. Increasing the amount of sodium carbonate to 50 percent completely eliminated sulfur dioxide formation within the detectable limits. The data also shows that sodium hydroxide as an alkali source by itself does not reduce the formation of sulfur dioxide (see Example 1).

TABLE I

| Example Number | $Na_2CO_3$ % on OD pulp | $SO_2$, ppm in vent gas | |
|---|---|---|---|
| | | Plant Rat | Gas Tech Tube |
| 1 | 0.00 | 10 | 5 |
| 2 | 0.22 | 10 | 2 |
| 3 | 0.33 | 2 | 0.5 |
| 4 | 0.50 | 0 | 0 |
| 5 | 0.75 | 0 | 0 |
| 6 | 1.00 | 0.2 | 0.1 |
| 7 | 1.50 | 0.1 | 0.1 |

What is claimed is:

1. A process for bleaching wood pulp with reduced formation of sulfur dioxide in a refiner whose contents comprise wood pulp, water and sodium hydrosulfite, wherein said process comprises the addition of at least one carbonate selected from the group consisting of lithium carbonate, sodium carbonate, potassium carbonate, magnesium carbonate and calcium carbonate and mixtures of two or more of the foregoing in an amount of at least from twenty to fifty percent by weight based on the sodium hydrosulfite, whereby the formation of sulfur dioxide is substantially reduced in comparison to use of sodium hydroxide, and wherein the sodium hydrosulfite and carbonates are present in the refiner simultaneously.

2. A process for bleaching wood pulp as claimed in claim 1, wherein said reduction of sulfur dioxide reduces the formation of sulfur dioxide to a level not exceeding two parts per million.

3. A process for bleaching wood pulp as claimed in claim 2, wherein said reduction of sulfur dioxide reduces the formation of sulfur dioxide to a level not exceeding one part per million.

4. A process as claimed in any of claims 1, 2, or 3 wherein said carbonate is sodium carbonate.

5. A process as claimed in any of claims 1, 2, or 3 wherein the carbonate is added in an amount between 33 and 50 weight percent inclusive based on the weight-of sodium hydrosulfite in the refiner.

6. A process as claimed in any of claims 1, 2, or 3 wherein the carbonate is sodium carbonate and is added in an amount between 33 and 50 weight percent inclusive based on the weight of sodium hydrosulfite in the refiner.

7. A process as claimed in any of claims 1, 2, or 3 wherein the carbonate is added at approximately the same time as the sodium hydrosulfite is added.

8. A process as claimed in any of claims 1, 2, or 3 wherein the carbonate is added simultaneously with the sodium hydrosulfite.

* * * * *